US006726521B2

(12) United States Patent
Peterson

(10) Patent No.: US 6,726,521 B2
(45) Date of Patent: Apr. 27, 2004

(54) AERODYNAMIC FLYING DISK HAVING LIGHT STICKS IN THE RIM

(76) Inventor: Lloyd E. Peterson, 13205 Lakeview Dr., Burnsville, MN (US) 55337

( * ) Notice: Subject to any disclaimer, the term of this patent is extended or adjusted under 35 U.S.C. 154(b) by 0 days.

(21) Appl. No.: 10/073,534

(22) Filed: Feb. 11, 2002

(65) Prior Publication Data

US 2003/0162470 A1 Aug. 28, 2003

(51) Int. Cl.[7] ..... A63H 27/00
(52) U.S. Cl. ..... 446/46
(58) Field of Search ..... 446/46, 47, 48

(56) References Cited

U.S. PATENT DOCUMENTS

| | | | | | |
|---|---|---|---|---|---|
| 3,786,246 | A | * | 1/1974 | Johnson et al. | |
| 4,086,723 | A | * | 5/1978 | Strawick | |
| 4,145,839 | A | * | 3/1979 | Sampietro | |
| 4,204,357 | A | * | 5/1980 | Harrington | |
| 4,212,131 | A | * | 7/1980 | Ross, Jr. | |
| 4,254,575 | A | * | 3/1981 | Gould | |
| 4,563,160 | A | * | 1/1986 | Lee | 446/47 |
| 4,778,428 | A | * | 10/1988 | Wield | 446/47 |
| 4,854,907 | A | * | 8/1989 | Holmes | 446/48 |
| 5,536,195 | A | * | 7/1996 | Stamos | 446/48 |
| 5,683,316 | A | | 11/1997 | Campbell | |
| 6,402,165 | B1 | * | 6/2002 | Redmond | 280/18.1 |
| D466,562 | S | * | 12/2002 | Peterson | D21/443 |

OTHER PUBLICATIONS

Drawings from Applicant's allowed design patent application 29/166,352.
Drawings from Applicant's allowed design patent application 29/155,508.
Star Lite Products Catalog dated 2002 showing Nite Lite golf ball (p. 1) and glow sticks (p. 2) for Nite Lite golf ball.
Linkaway Golf web page showing availability of Nite Lite golf ball since Jun. 6, 1999 under Star Lite Products listing (p. 7).
Photograph (undated) showing Nite Lite golf ball.

* cited by examiner

*Primary Examiner*—Derris W. Banks
*Assistant Examiner*—Ali Abdelwahed
(74) *Attorney, Agent, or Firm*—James W. Miller

(57) ABSTRACT

An aerodynamic flying disk, i.e. such as a FRISBEE®, comprises a circular disk body having a circumferential rim. A groove is provided in the rim. A plurality of light sticks are located in various sections of the groove. The light sticks are bent and snapped to activate a chemical light producing reaction and after such activation may be placed into the sections of the groove. Thereafter, during the time the light sticks continue to glow, the flying disk when thrown and flown through the air will have an illuminated circumferential rim, enhancing the user's enjoyment in using and/or playing with the flying disk.

17 Claims, 5 Drawing Sheets

AERODYNAMIC FLYING DISK HAVING LIGHT STICKS IN THE RIM

TECHNICAL FIELD

This invention relates to an aerodynamic flying disk, such as a FRISBEE®, which can be gripped by the rim and thrown by the user to cause the flying disk to fly through the air. More particularly, this invention relates to such a flying disk equipped with one or more light sticks for providing visual effects as the flying disk flies through the air.

BACKGROUND OF THE INVENTION

Aerodynamic flying disks are widely known. The trademark FRISBEE® refers to one such flying disk. Flying disks of this type have a circular disk body bounded by a circumferential rim. The user can grip the flying disk by the rim and with a flick of the wrist and arm can throw the flying disk with a spinning motion. This spinning motion along with the impetus of the throwing action causes the flying disk to fly through the air, often over quite a long distance. Flying disks of this type are a popular play and entertainment device.

It has been suggested that the entertainment value of aerodynamic flying disks could be enhanced by adding lights to the flying disk. This has been done in the past, however, by attempting to use naturally phosphorescent or luminescent materials to make the flying disks. Such attempts have been unsatisfactory as the light given off by such materials is quite weak. In addition, such materials gradually lose their light emitting qualities, becoming ineffective after a time.

Other attempts to provide illuminated flying disks have involved adding light bulbs or LED's to the flying disks along with batteries to power them. Again, this involves various problems, such as the weight added by the batteries to the flying disk and the need to replace the batteries. Accordingly, flying disks equipped with such battery operated light emitting elements have not been commercially successful.

SUMMARY OF THE INVENTION

One aspect of this invention relates to an aerodynamic flying disk which comprises a circular disk body having a top wall and a circumferential rim. The disk body is capable of being thrown by gripping the circumferential rim of the disk body and by throwing and spinning the disk body to cause the disk body to fly through the air. At least one light emitting element is carried on the circumferential rim of the disk body.

Another aspect of this invention relates to an aerodynamic flying disk comprising a throwable disk body. At least one light stick is provided comprising a flexible plastic tube which produces a light when the tube is bent and snapped to activate chemicals contained inside the tube which chemicals produce light when activated. A groove is provided on the disk body for releasably retaining the light stick.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

An aerodynamic flying disk according to this invention is illustrated generally as 2. Flying disk 2 to which this invention relates can be thrown by a person who grabs one side of flying disk 2 and throws flying disk 2 with a flick of the wrist and arm. This propels flying disk 2 with a spinning motion and causes flying disk 2 to fly for some distance. Such flying disks 2 are well known per se and some are often sold under the trademark FRISBEE®, which trademark is owned by Wham-O-Mfg. Co.

Figure 9:
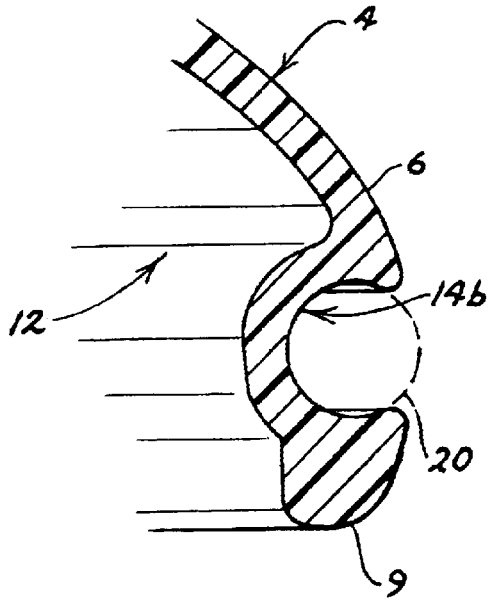
FIG. 9 is an enlarged cross-sectional view of a portion of the circumferential rim of the flying disk shown in FIG. 1, taken along lines 9—9 of FIG. 6.

Flying disk 2 comprises a circular disk body 4 having a circumferential rim 6 which extends 360° around disk body 4. Disk body 4 has a top wall 8 which may be relatively flat or slightly domed. Circumferential rim 6 terminates in a lower edge 9. See FIG. 9. The underside of disk body 4 is open to form an interior cavity 12 underlying top wall 8.

The description of flying disk 2 given above is meant simply to set forth the general structure of a flying disk of the type to which this invention relates. The exact size and shape of flying disk 2 and how flat or domed top wall 8 of flying disk 2 might be are not important to this invention. All that is required is that flying disk 2 have a size and shape which allows a person to grab flying disk 2 and to throw flying disk 2 with a flick of the wrist and arm with such throwing motion causing flying disk 2 to spin and thus fly through the air.

Figure 3:
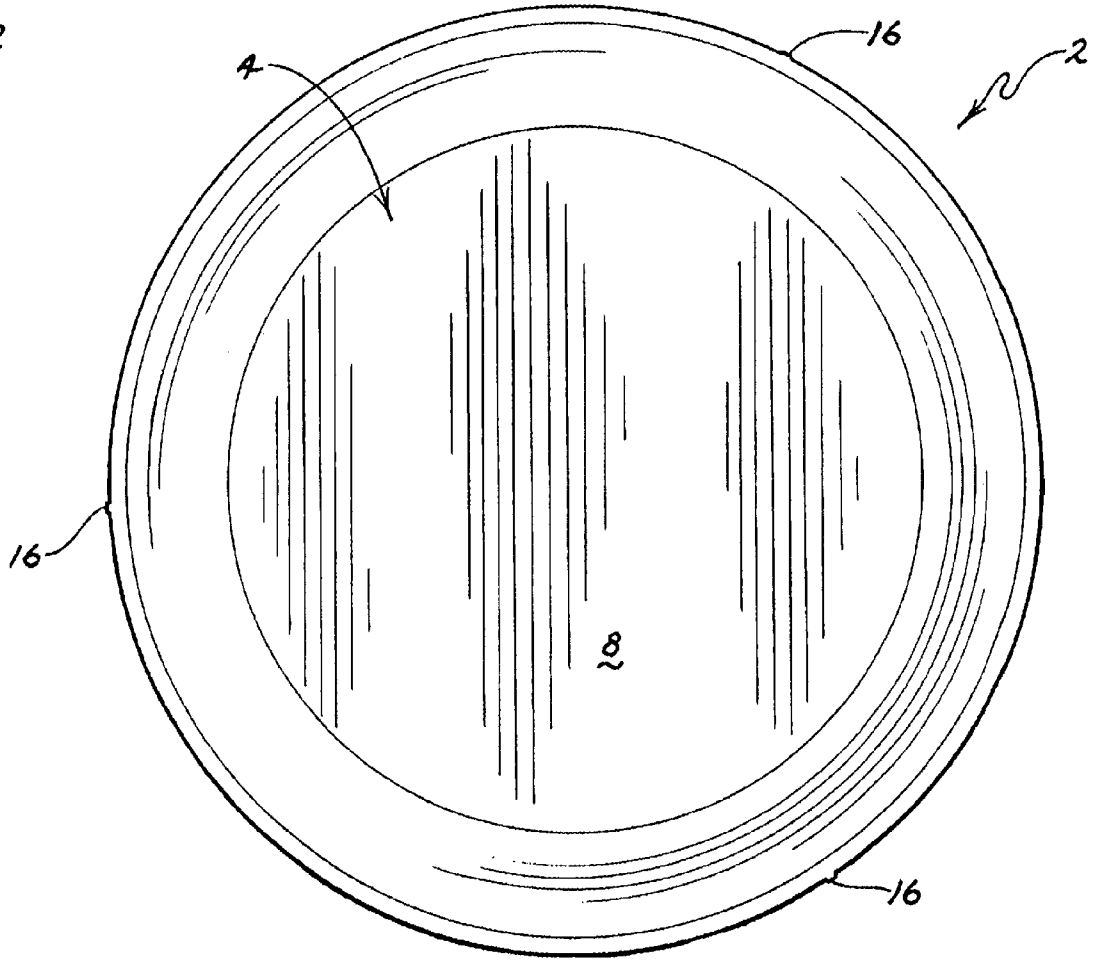
FIG. 3 is a top plan view of the flying disk shown in FIG. 1.
Figure 4:
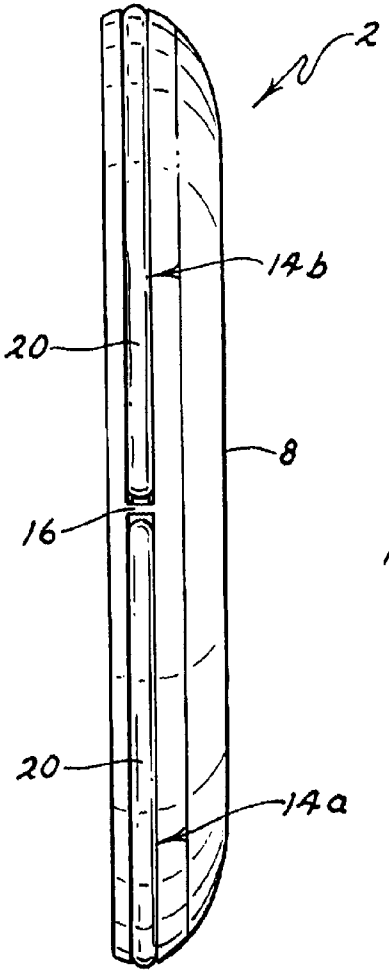
FIG. 4 is a side elevational view of the flying disk shown in FIG. 1, particularly illustrating the flying disk in an upright orientation and with the light sticks being installed in the groove sections.
Figure 6:
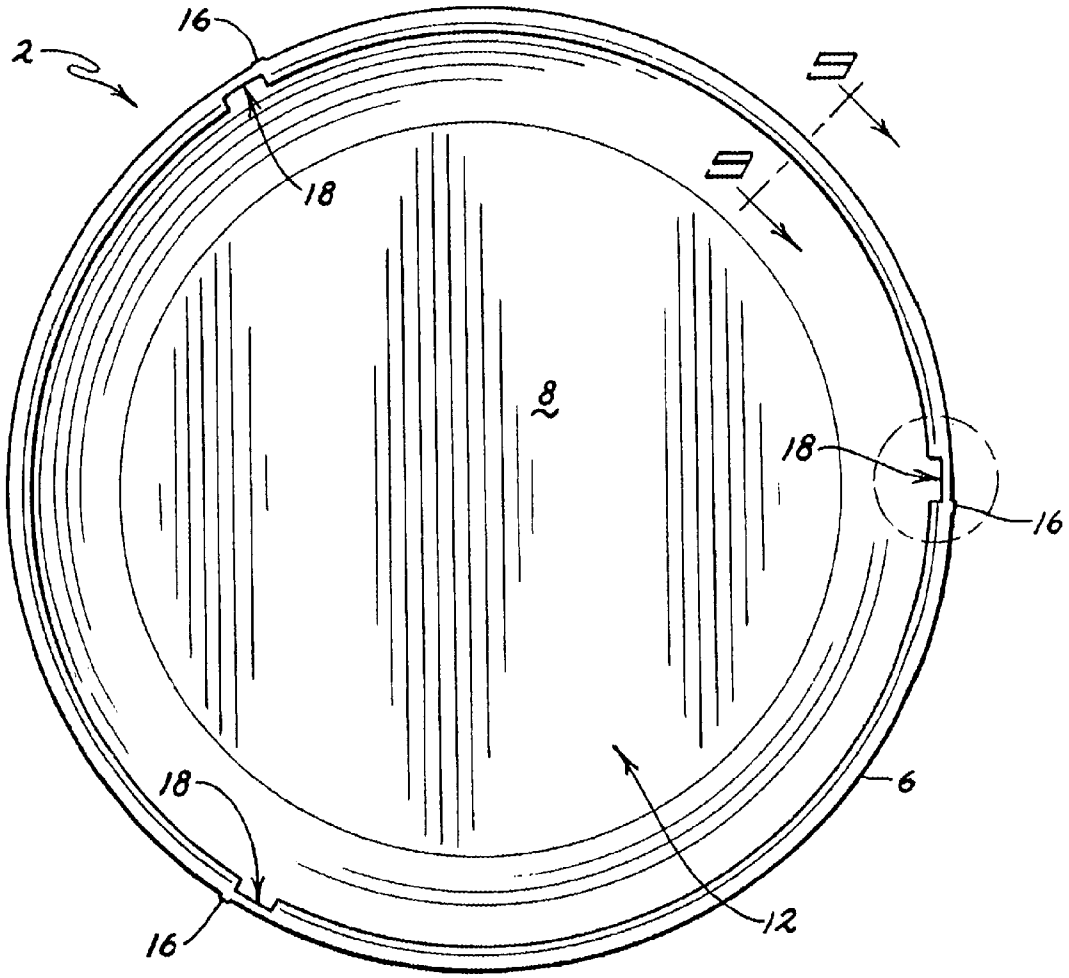
FIG. 6 is a bottom plan view of the flying disk shown in FIG. 1.
Figure 5:
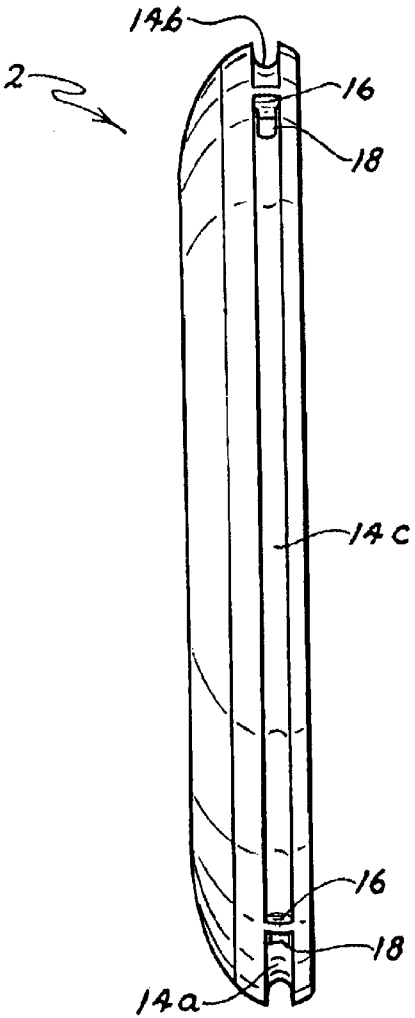
FIG. 5 is a side elevational view of the flying disk shown in FIG. 1, particularly illustrating the flying disk in an inverted orientation and with the light sticks being removed from the groove sections for the purpose of clarity.
Figure 7:
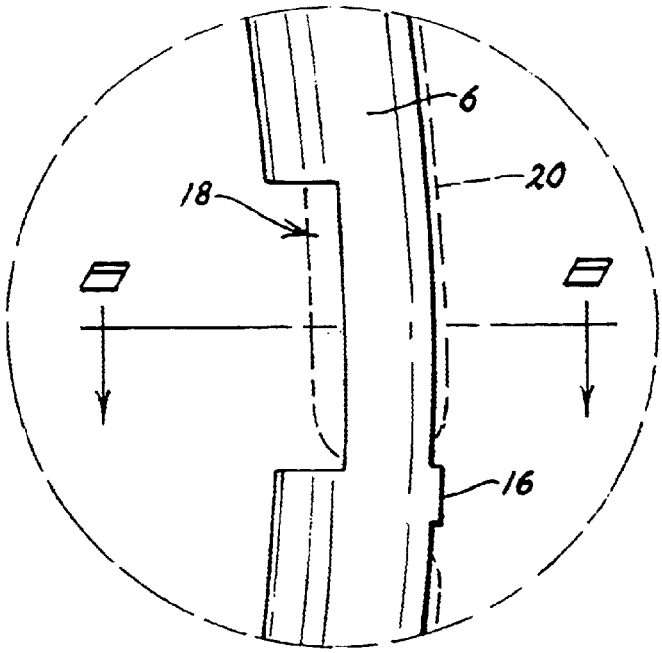
FIG. 7 is an enlarged bottom plan view of that portion of the circumferential rim of the flying disk which is circled in FIG. 6.

Flying disk 2 of this invention has a radially outwardly facing groove 14 provided in circumferential rim 6 of flying disk 2. Groove 14 is separated into three sections 14*a*, 14*b* and 14*c* extending around the circumference of disk body 4. As shown in FIG. 3, groove sections 14*a*, 14*b*, and 14*c* are provided by three ribs 16 which are basically nongrooved or solid portions of circumferential rim 6. Ribs 16 may stick radially outwardly slightly from circumferential rim 6 as shown in FIG. 3.

Openings 18 are provided in circumferential rim 6 leading into the rear of each separate section 14*a*, 14*b* and 14*c* of groove 14. Since three sections 14*a*, 14*b* and 14*c* are provided in groove 14 by three ribs 16, three openings 18 are also provided, each opening 18 leading into one of the sections. If more sections were provided in groove 14 by more ribs 16, then more openings 18 would be used. It would also be possible for each groove section 14*a*, 14*b* and 14*c* to have more than one opening 18. For example, there could be two circumferentially spaced openings 18 for each section of groove 14.

The purpose of openings 18 will be described in more detail hereafter. However, openings 18 are basically present to provide access to the rear of groove sections 14*a*, 14*b* and 14*c* from interior cavity 12 of flying disk 2.

Each groove section 14*a*, 14*b* and 14*c* carries a light stick 20, which is also sometimes referred to as a glow stick. Light sticks 20 are themselves well known and comprise flexible plastic tubes which enclose a chemical carrying capsule. When light sticks 20 are bent and snapped, the capsule is broken to allow the chemicals to be mixed by shaking light sticks 20. The chemicals then react to produce a vibrant light.

Light sticks 20 come in different lengths and can produce light of different colors. This light lasts for a number of hours once the chemical reaction begins. Light sticks 20 do not glow or give off light prior to the time they are activated or after the chemical light producing reaction ends. One type of light stick that may be used is that known as a Beaver Safety Light Stick manufactured by Clean-Cut Skin Enterprise Co., Ltd. in Taichung, Taiwan.

Each groove section 14*a*, 14*b* and 14*c* has a length which is chosen to approximately match the length of light sticks 20. In other words, each light stick 20 can be inserted into a groove section 14*a*, 14*b* and 14*c* and when so inserted will extend over most or all of the length of groove section 14*a*, 14*b* and 14*c*. In addition, the cross-sectional shape of groove section 14*a*, 14*b* and 14*c* is chosen to slightly pinch or grip the outer diameter of light stick 20 with a frictional fit. Thus, when light sticks 20 are inserted into their respective sections of groove 14, they are simply held therein with a press fit. This press fit must, however, be tight enough so that light sticks 20 will not become dislodged from flying disk 2 even when flying disk 2 has been thrown and is flying through the air.

Figure 1:
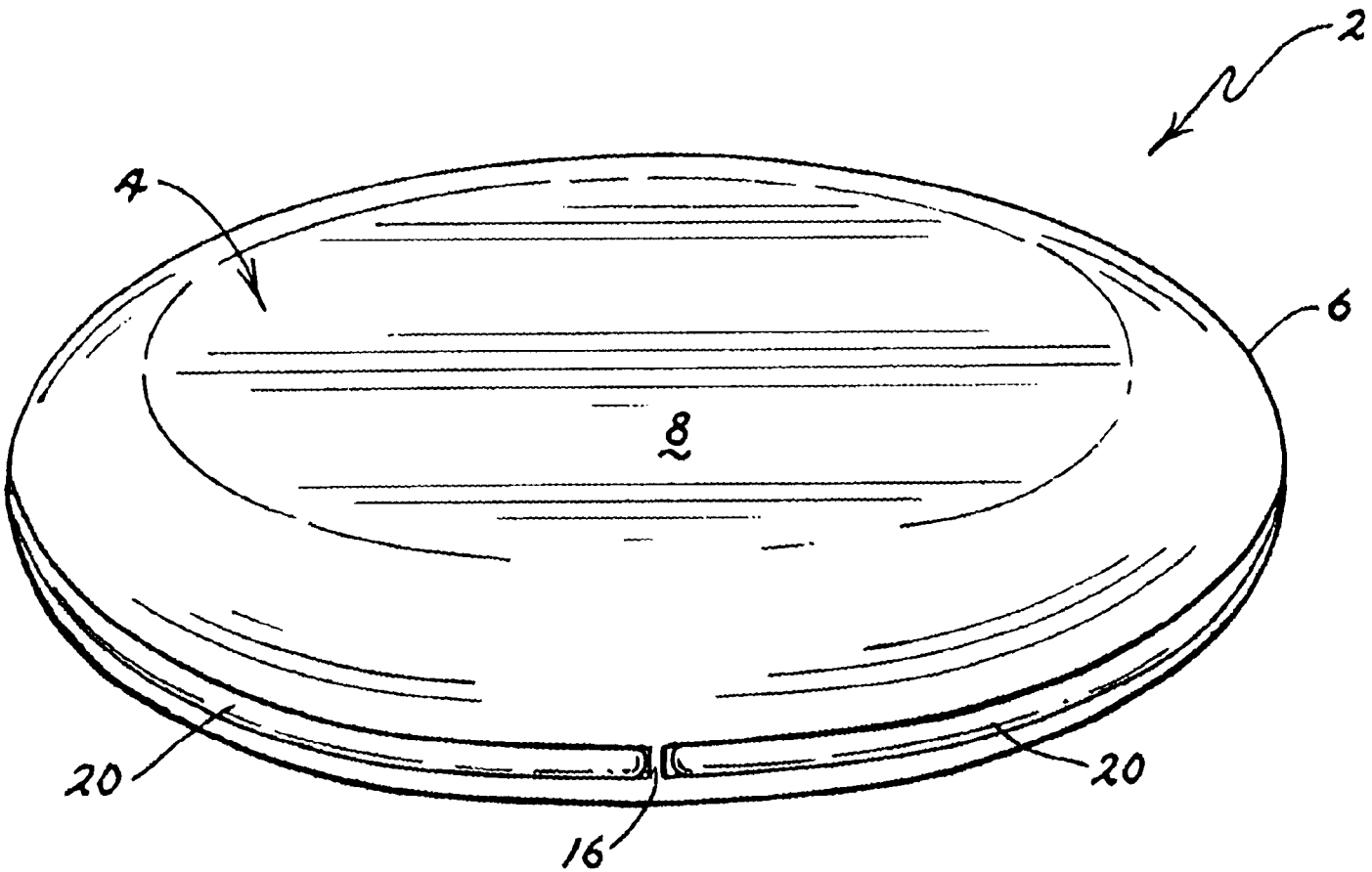
FIG. 1 is a perspective view of a throwable aerodynamic flying disk according to this invention, particularly illustrating the flying disk with light sticks carried in the circumferential rim of the flying disk.
Figure 2:
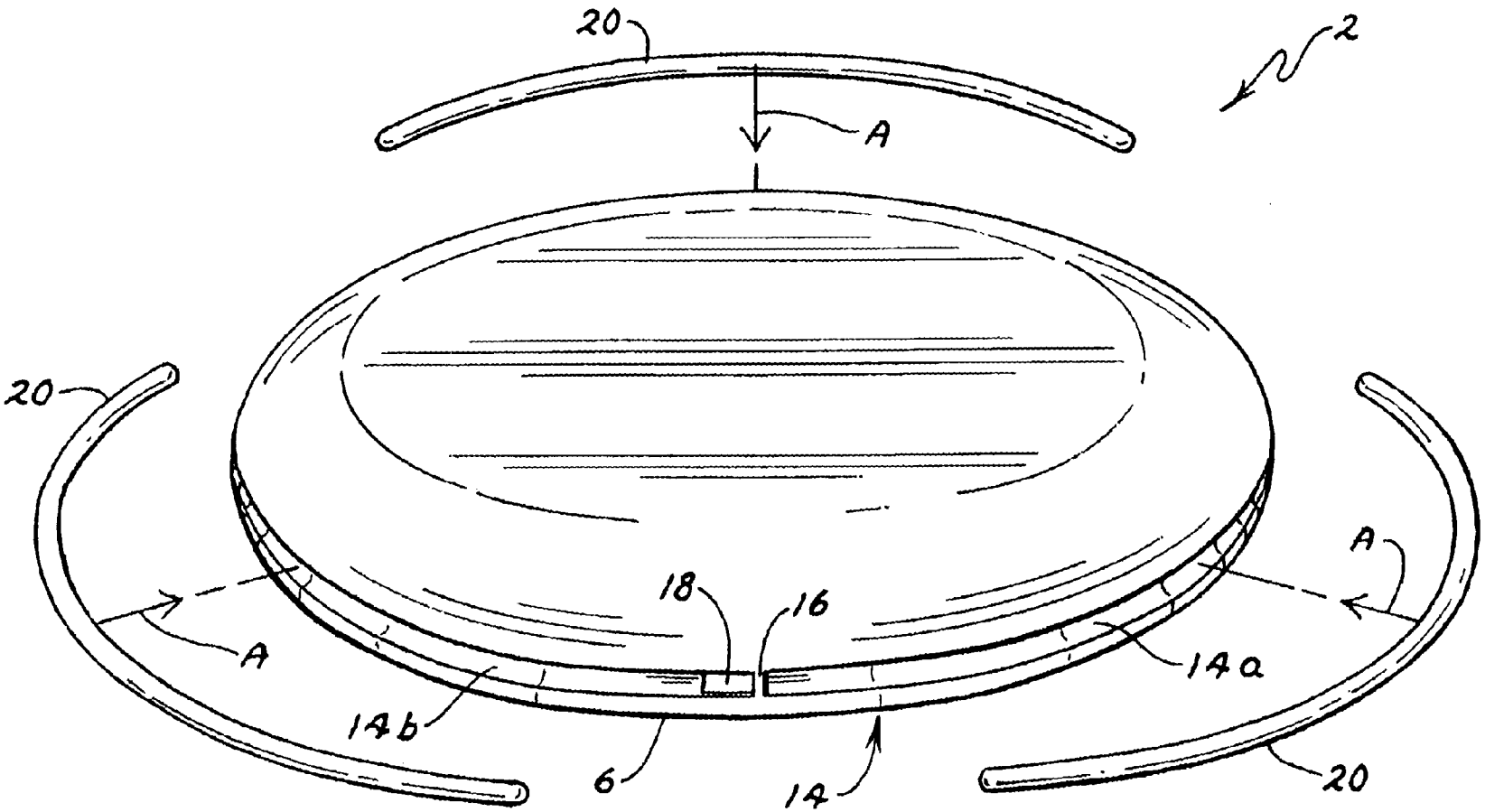
FIG. 2 is a perspective view of the flying disk shown in FIG. 1, illustrating the light sticks separated from the flying disk prior to assembly of the light sticks with the flying disk.

FIG. 2 shows light sticks 20 prior to insertion into sections 14*a*, 14*b* and 14*c* of groove 14. Light sticks 20 can be pushed into sections 14*a*, 14*b* and 14*c* of groove 14 as indicated by the arrows A in FIG. 2 until they are gripped and held in sections 14*a*, 14*b* and 14*c* of groove 14. The user would, of course, first bend and snap light sticks 20 immediately prior to insertion in order to initiate the chemical reaction that produces the light. After light sticks 20 begin glowing, they can be inserted into sections 14*a*, 14*b* and 14*c* of groove 14. The light provided by such light sticks 20 will then last for a number of hours.

Flying disk 2 of this invention will enhance the entertainment value in using or playing with flying disk 2. The colored light given off from circumferential rim 6 of flying disk 2 will be quite pretty and will provide a dynamic visual appearance as flying disk 2 is flown, particularly when flying disk 2 is flown at dusk or night or in other low light conditions. In fact, flying disk 2 of this invention lends itself to being used at times when unlighted flying disks could not even be seen. This should encourage and increase use of flying disk 2.

Figure 8:
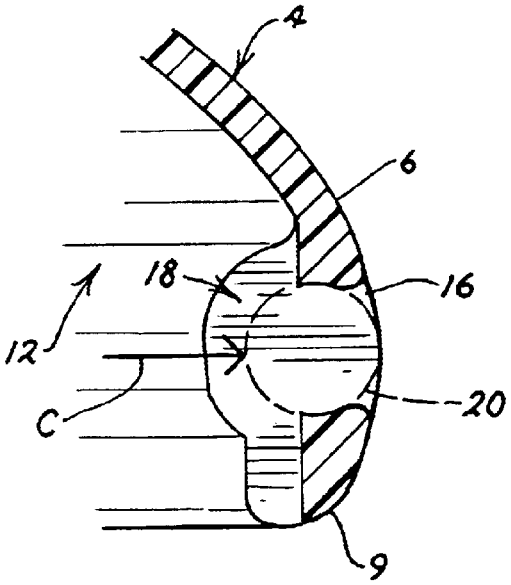
FIG. 8 is an enlarged cross-sectional view of a portion of the circumferential rim of the flying disk shown in FIG. 1, taken along lines 8—8 of FIG. 7.

Because the light provided by the chemical reactions inside light stick 20 lasts only for a number of hours, light sticks 20 will eventually stop glowing. These depleted light sticks must be replaced if one wishes to continue to use flying disk 2 with the light emitting properties provided by light sticks 20. The user can easily remove or dislodge depleted light sticks from sections 14*a*, 14*b* and 14*c* of groove 14 using openings 18. The user simply puts a finger into interior cavity 12 of flying disk 2 and into and through opening 18 in a groove section 14*a*, 14*b* or 14*c* until the user's finger contacts the back of light stick 20. The user can then simply push outwardly on the back of light stick 20, as shown by the arrow C in FIG. 8, to push a depleted light stick out of that groove section 14*a*, 14*b* or 14*c* in which that light stick 20 had been held.

A number of original and replacement light sticks 20 will desirably be packaged and sold with flying disk 2 when flying disk 2 is sold. Even the original light sticks will probably not be pre-installed in their respective sections of groove 14 since such pre-installed light sticks 20 might accidentally be activated during shipment or sale of flying disk 2. Instead, upon purchasing a flying disk 2 of this invention, the user would, upon initial use of flying disk 2, take three of the packaged light sticks 20, bend and snap them to initiate the chemical reactions that produce the light, and then insert light sticks 20 into sections 14*a*, 14*b* and 14*c* of groove 14. At some time after these original light sticks are depleted, and immediately prior to the next use of flying disk 2, the user would remove the depleted light sticks from sections 14*a*, 14*b* and 14*c* of groove 14 and insert replacement light sticks, after first bending and snapping the replacement light sticks to initiate the chemical light producing reaction.

As light sticks 20 can produce light in different colors, a number of light sticks 20 capable of producing different colors will desirably be packaged with flying disk 2. The user can then select what colors are to be used in combination with one another according to the user's individual taste.

Various additional modifications of this invention are apparent to those skilled in the art. For example, groove 14 that holds light sticks 20 is desirably placed on circumferential rim 6 of flying disk 2 as this least disturbs the aerodynamic characteristics of flying disk 2. However, other grooves holding light sticks could be placed on top wall 8 of flying disk 2, either in addition to groove 14 in circumferential rim 6 or in place of such groove 14. Moreover, the number of sections 14*a*, 14*b* and 14*c* of groove 14 used in circumferential rim 6 of flying disk 2, and the angular extent of such sections of groove 14, could obviously be varied. While it is preferred that groove 14 extend around the entire circumferential rim 6 of flying disk 2 in a substantially continuous manner so that the entire rim looks to be lighted when light sticks 20 are activated, sections 14*a*, 14*b* and 14*c* of groove 14 in circumferential rim 6 could be noncontinuous and could be separated by relatively long lands or solid sections. In this case, the light glowing from circumferential rim 6 would be a series of spaced sections of light and not a more or less continuous band of light.

Different ways of removing depleted light sticks from sections 14*a*, 14*b* and 14*c* of groove 14 could also be used. For example, rather than having openings 18 into the rear of groove 14 for popping light sticks 20 out of groove 14, openings might be provided in top wall 8 of flying disk 2 adjacent groove 14 for allowing the insertion of a prying implement behind light sticks 20 to pop them out. Alternatively, interior cavity 12 of light sticks 20 could be provided with some type of push button that would engage against the back of a light stick received in groove 14 to allow the user to push in on the button so that movement of the button would push light stick 20 out of groove 14.

While groove 14 in circumferential rim 6 is formed into different sections by ribs 16, ribs 16 could be deleted so that groove 14 would be continuous all the way around circumferential rim 6 of flying disk 2. Light sticks 20 could be laid in an abutting end-to-end relationship around such a continuous groove. In the event that a long enough and flexible enough light stick 20 is available, the entire groove 14 could be filled with a single light stick 20.

Thus, this invention is to be limited only by the appended claims

I claim:

1. An aerodynamic flying disk, which comprises:

(a) a circular disk body having a topside formed by a top wall and a circumferential rim and an underside formed by an interior cavity underlying the top wall and inside the circumferential rim, the disk body capable of being thrown by gripping the circumferential rim of the disk body and by throwing and spinning the disk body to cause the disk body to fly through the air;

(b) a circular groove on the topside of the disk body extending substantially 360° around the disk body; and (c) at least one light stick that produces light using a chemical light producing reaction when the light stick is selectively bent and snapped, wherein the light stick is removably retained in the circular groove on the topside of the disk body by a frictional press fit such that the light stick can be installed in the groove after the light producing reaction has been initiated and can be removed from the groove after the light producing reaction is spent, the light stick when installed in the groove being visible from the topside of the disk body without the light stick being obscured in the interior cavity forming the underside of the disk body.

2. The flying disk of claim 1, wherein the groove into which the light stick is removably insertable is located on the circumferential rim of the disk body.

3. The flying disk of claim 2, further including an opening adjacent the grove for allowing a user to push the light stick out of the groove to replace the light stick.

4. An aerodynamic flying disk, which comprises:

(a) a throwable disk body;

(b) a plurality of light sticks, wherein each light stick comprises a flexible plastic tube which produces a light when the tube is bent and snapped to activate chemicals contained inside the tube which chemicals produce light when activated; and (c) a groove on the disk body for releasably retaining the plurality of light sticks in an end-to-end relationship, wherein the groove is separated into a plurality of sections by ribs, and wherein at least one light stick is provided in each section of the groove.

5. The flying disk of claim 4, wherein the groove is on a circumferential rim portion of the disk body and faces radially outwardly.

6. An aerodynamic flying disk, which comprises:

(a) a circular disk body having a size and shape that allows the disk body to be spun and thrown by a user with the disk body flying through the air as it spins, wherein the disk body includes a top wall and a circumferential rim;

(b) a radially outwardly facing groove provided in the circumferential rim extending at least partially around the circumferential rim of the disk body; and (c) at least one light stick located within the groove which light stick provides a light from a chemical reaction, wherein the groove opens radially outwardly to be open to and accessible from positions radially outside the circumferential rim such that the light stick can be inserted into the groove by aligning the light stick with the groove and by pushing the light stick radially inwardly towards the circumferential rim until the light stick enters and is received within the groove in the circumferential rim, the light stick being insertable into the groove when the chemical reaction has been initiated so that the light provided by the light stick can be seen as the disk body flies through the air and being removable from the groove after the chemical reaction is spent to allow a depleted light stick to be replaced with a replacement light stick.

7. The flying disk of claim 6, wherein the groove extends completely around the circumferential rim of the disk body.

8. The flying disk of claim 7, wherein a plurality of light sticks are carried in the groove.

9. The flying disk of claim 8, wherein the groove is separated into a plurality of sections by ribs, and wherein at least one light stick is provided in each section of the groove.

10. The flying disk of claim 9, wherein each section has a length and the ribs are relatively narrow compared to the length of the sections of the groove.

11. The flying disk of claim 9, wherein only one light stick is provided in each section of the groove.

12. The flying disk of claim 6, wherein the at least one light stick is frictionally retained within the groove.

13. The flying disk of claim 6, further including an opening in the disk body to provide access behind the at least one light stick to permit removal of the at least one light stick when the at least one light stick is depleted and no longer emits light.

14. The flying disk of claim 13, wherein the disk body includes an inner cavity beneath the top wall and inside the circumferential rim, and wherein the opening is placed in the circumferential rim behind a portion of the groove to allow access behind the at least one light stick to allow the at least one light stick to be pushed out of the groove.

15. The flying disk of claim 4, wherein a single light stick is provided in each section of the groove.

16. The flying disk of claim 4, wherein the groove extends 360° around the disk body.

17. An aerodynamic flying disk, which comprises:

(a) a throwable disk body;

(b) at least one light stick comprising a flexible plastic tube which produces a light when the tube is bent and snapped to activate chemicals contained inside the tube which chemicals produce light when activated; and (c) a groove on the disk body for releasably retaining the light stick, further including an opening in the disk body behind the light stick to provide access behind the at least one light stick to permit removal of the at least one light stick when the at least one light stick is depleted and no longer emits light.

* * * * *